US005882446A

United States Patent [19]

Konter

[11] Patent Number: 5,882,446

[45] Date of Patent: Mar. 16, 1999

[54] HEAT TREATMENT PROCESS FOR MATERIAL BODIES MADE OF NICKEL BASE SUPERALLOYS

[75] Inventor: Maxim Konter, Untersiggenthal, Switzerland

[73] Assignee: ABB Research Ltd., Zurich, Switzerland

[21] Appl. No.: 843,642

[22] Filed: Apr. 10, 1997

[30] Foreign Application Priority Data

Apr. 29, 1996 [DE] Germany ..... 196 17 093.1

[51] Int. Cl.[6] ..... C22F 1/10

[52] U.S. Cl. ..... 148/562; 148/675

[58] Field of Search ..... 148/555, 556, 148/562, 675, 676, 677, 404, 410, 428

[56] References Cited

U.S. PATENT DOCUMENTS

| | | | |
|---|---|---|---|
| 3,898,109 | 8/1975 | Shaw | 148/410 |
| 4,459,160 | 7/1984 | Meetham et al. | 148/410 |
| 4,583,608 | 4/1986 | Field et al. | 148/410 |
| 4,624,716 | 11/1986 | Noel et al. | 148/675 |
| 4,643,782 | 2/1987 | Harris et al. . | |
| 4,712,540 | 12/1987 | Harris et al. | 148/404 |
| 4,721,540 | 1/1988 | Harris et al. | 148/410 |
| 5,240,518 | 8/1993 | Wortman et al. | 148/410 |
| 5,489,346 | 2/1996 | Erickson | 148/404 |
| 5,509,980 | 4/1996 | Lim | 148/675 |

*Primary Examiner*—Margery Phipps
*Attorney, Agent, or Firm*—Burns, Doane, Swecker & Mathis, L.L.P.

[57] ABSTRACT

In a heat treatment process for material bodies made of nickel base superalloys, in particular for monocrystals made of nickel base superalloys, the heat treatment of the material body comprises the following steps: annealing at 850° C. to 1100° C., heating to 1200° C., heating to a temperature of 1200° C.<T≦1300° C. at a heat-up rate of less than or equal to 1° C./min, and a multistage homogenization and dissolution process at a temperature of 1300° C.≦T≦1315° C.

15 Claims, 3 Drawing Sheets

HEAT TREATMENT PROCESS FOR MATERIAL BODIES MADE OF NICKEL BASE SUPERALLOYS

BACKGROUND OF THE INVENTION

1. Field of the Invention

The invention relates to a heat treatment process for material bodies made of nickel base superalloys.

2. Discussion of Background

Heat treatment processes of this kind for material bodies made of nickel base superalloys are known from U.S. Pat. No. 4,643,782, which describes nickel base superalloys with the trade name "CMSX", from which monocrystal components can be cast, in particular blades for gas turbines. Such a nickel base superalloy having the designation "CMSX-4" is essentially composed of (in % by weight): 9.3–10.0 Co, 6.4–6.8 Cr, 0.5–0.7 Mo, 6.2–6.6 W, 6.3–6.7 Ta, 5.45–5.75 Al, 0.8–1.2 Ti, 0.07–0.12 Hf, 2.8–3.2 Re, remainder nickel.

According to U.S. Pat. No. 4,643,782, these nickel base superalloys are subjected to a heat treatment in order to dissolve the γ' phase and the γ/γ' eutectic and to produce regular γ' particles in an aging process.

However, due to excessively high stresses in the casting process between mold and casting, uncontrollable recrystallizations may occur following solution annealing of the castings, which leads to high reject rates during production. Furthermore, due to the low cooling rates in the monocrystal casting process, a coarse γ' structure is formed in the casting compared to conventional castings. In addition, the dendritic segregation in the monocrystal casting process is higher, which leads to a lower phase stability. Good diffusion annealing is therefore required in order that no brittle phases should be deposited during use, i.e. aging, of the monocrystalline casting.

SUMMARY OF THE INVENTION

Accordingly, one object of the invention is to provide a homogeneous, stable structure which has a high creep strength, fatigue strength and good aging properties using a heat treatment process for material bodies made of nickel base superalloys of the type mentioned at the outset.

According to the invention, this is achieved by a heat treatment of the material body which comprises the following steps: annealing at 850° C. to 1100° C., heating to 1200° C., heating to a temperature of 1200° C.<T≦1300° C. at a heat-up rate of less than or equal to 1° C./min, and a multistage homogenization and dissolution process at a temperature of 1300° C.≦T≦1315° C.

The advantages of the invention are to be considered to include, inter alia, the fact that the process closes dislocation sources and thus prevents the formation of further dislocations. Furthermore, recrystallization is avoided during the heating process and the annihilation of the dislocation network is intensified. The multistage homogenization and dissolution process produces a very good homogenization of the material bodies. The remaining eutectic of 1 to 4% by volume is sufficient to pin the grain boundaries of recrystallization grains.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein micrographs of heat-treated specimens of the alloy "CMSX-4" and a heat treatment process are illustrated and wherein.

DESCRIPTION OF THE PREFERRED EMBODIMENT

Monocrystalline castings, in particular blades for gas turbines, were produced from the abovementioned alloy "CMSX-4". The castings were subjected to the following heat treatment process:

a) The monocrystalline blade was stress-relief-annealed for at least 2 hours at 850° to 1100° C., preferably for 1 to 4 hours at 930° to 970° C., in particular at about 950° C., and for 2 to 20 hours at 1030° to 1070° C., in particular at about 1050° C.

The driving force behind recrystallizations are dislocations if the dislocation density exceeds the critical value. The above-described stress relief annealing has the object of closing dislocation sources (such as for example Frank-Read sources or internal stress concentrations), in order to prevent the formation of further dislocations. This is necessary in order to permit annihilation of the dislocation network in the following heat treatment step c).

However, the stress relief annealing alone is insufficient to avoid recrystallization if the local deformation in the material exceeds 3% (Table 1).

b) The monocrystalline blade was then heated to 1200° C. at a heat-up rate of 2° to 20° C./min, preferably at a heat-up rate of 5° C./min.

c) The monocrystalline blade was then heated above the γ' solidus curve, i.e. to 1200° to 1300° C. at a heat-up rate of less than 1° C./min, preferably at a heat-up rate of 0.5° C./min, with the object of annihilating the dislocation network before the γ' phase is dissolved.

Below a temperature of 1200° C., the dislocation movement is inhibited by the γ' particles and recrystallization is impossible. At higher temperatures, when the γ' phase is dissolved, i.e. at 1200° to 1300° C. for CMSX-4, recrystallization of grains in the regions having the greatest dislocation densities and annihilation of the dislocation network due to the movement of the dislocations are competing with one another. At a low heat-up rate of less than 1° C./min, the annihilation of the dislocation network due to the dislocation movement gains the upper hand. Experiments have shown that at higher heat-up rates, recrystallization begins even during the heating process.

Figure 1:
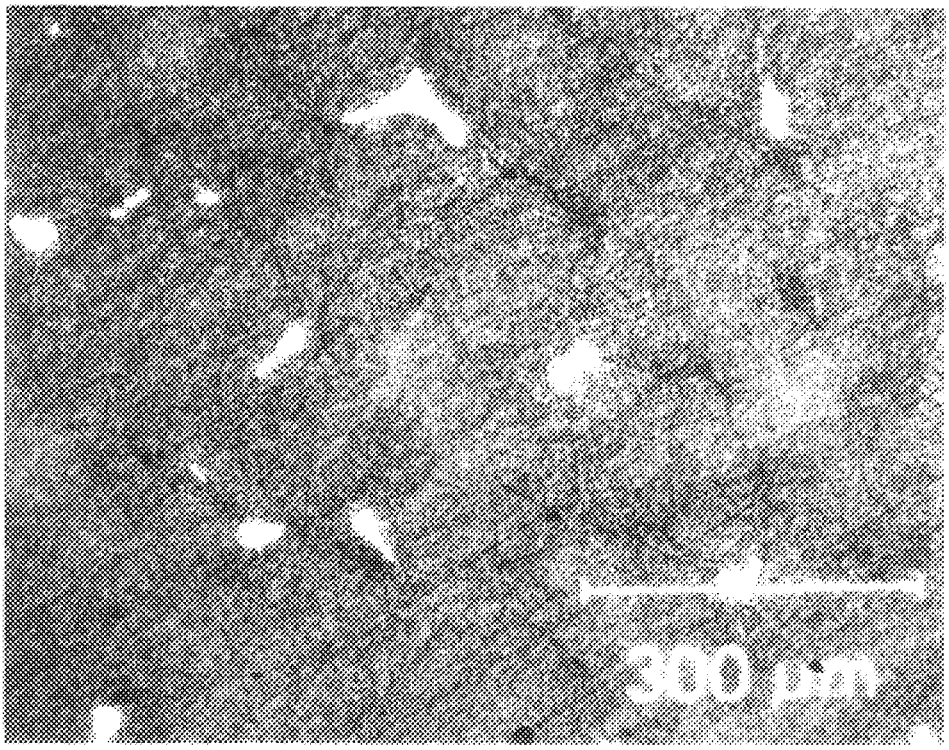
FIG. 1 shows an alloying structure in accordance with the homogenization and dissolution process corresponding to the heat treatment process according to the invention.

If only a low heat-up rate is used, i.e. the stress relief annealing according to a) and the subsequent heat treatment step d) are omitted, recrystallization does, however, occur if the local deformation in the material exceeds 3.5% (Table 1).

d) There then follows a multistage process in the temperature range of 1300° C.≦T≦1315° C., in order to homogenize and dissolve the crudely cast γ' phase, combined with a residual eutectic of 1 to 4% by volume. FIG. 1 shows the homogenized and dissolved γ' phase with particles of residual eutectic.

This homogenization and dissolution process preferably comprises two steps: annealing at about 1300° C. for about 2 hours and then at about 1310° C. for 6 to 12 hours.

Figure 2:
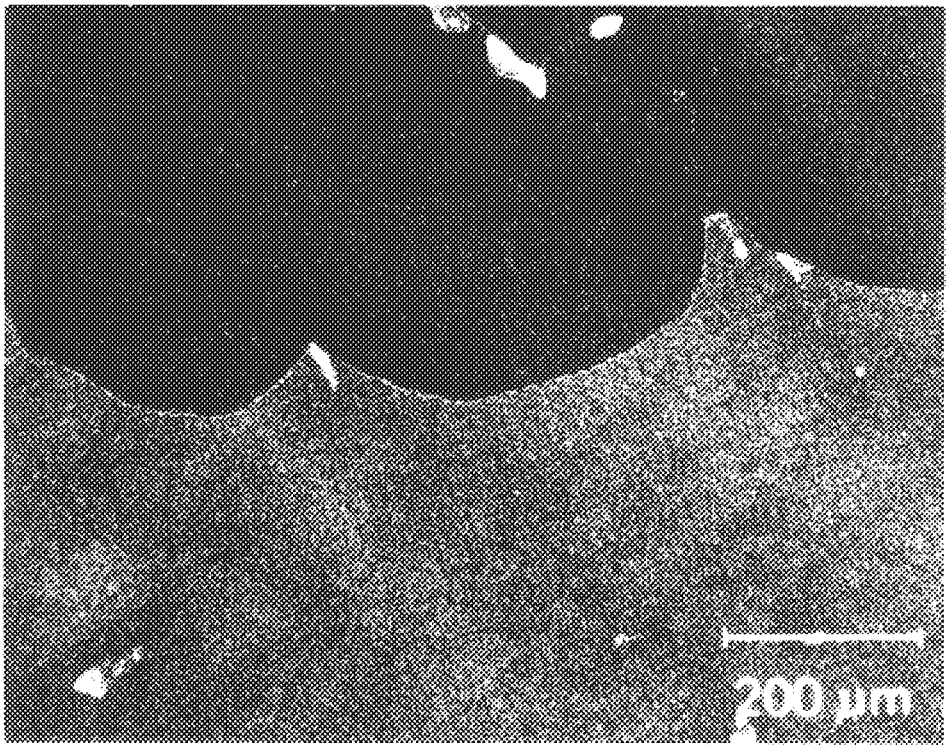
FIG. 2 shows recrystallization grain boundaries pinned by particles of the remaining eutectic.

The growth of new grains during the solution annealing can be impeded by particles of the remaining eutectic, by the temperature and by the dissolution time. FIG. 2 shows a grain boundary, pinned by the residual eutectic, of a recrystallization grain. In Table 2, the heat treatment process according to the invention is compared with the process according to U.S. Pat. No. 4,643,782.

Figure 3:
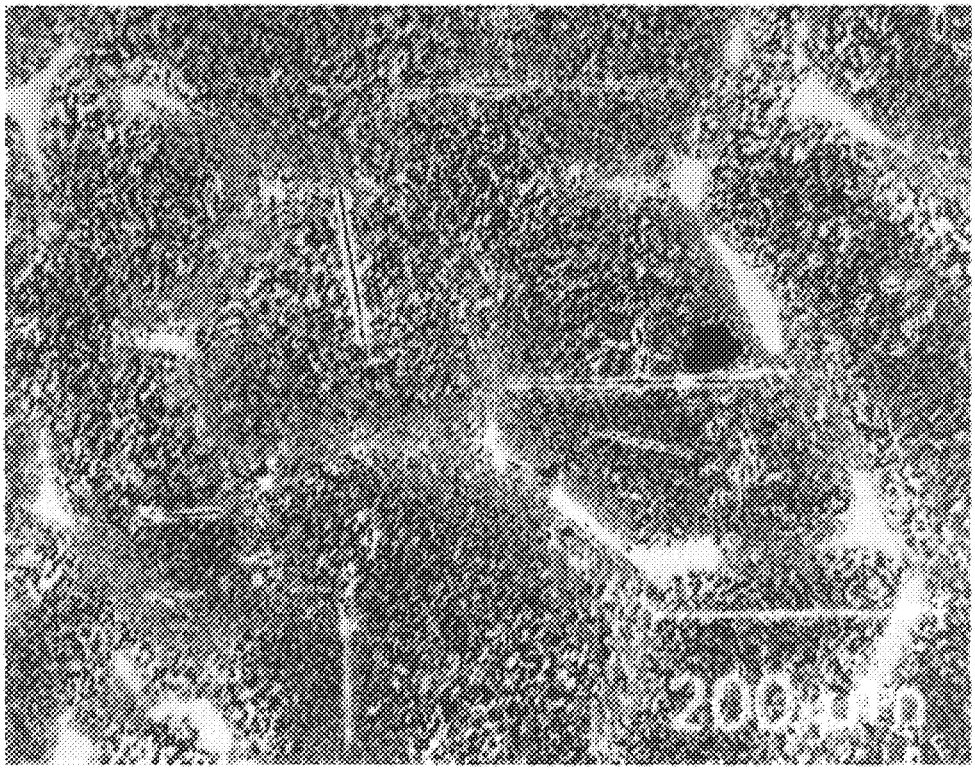
FIG. 3 shows acicular particles of a brittle, Re—Cr-rich phase, the specimen having been solution-annealed at temperatures below 1300° C.

In the specimens produced according to U.S. Pat. No. 4,643,782, a remaining eutectic of 7 to 8% and recrystallization grains having a very small diameter (≈0.5 mm) are formed. However, due to the solution annealing at temperatures of below 1300° C., brittle, Re—Cr-rich particles are formed during aging or use of these specimens at 1050° C. These acicular Re—Cr-rich particles are shown in FIG. 3. This brittle particle results in poor creep and fatigue properties. The grain boundaries of the recrystallization grains are pinned by the particles of the remaining eutectic and are thus prevented from growing. The. recrystallization grains which are usually formed on the surface of the specimen bodies may be abraded during machining of the blades. In the case of blades, the recrystallization grains occurring inside the blades, for example at the cooling ducts, can be disregarded, since there are no high stresses occurring there.

The heat treatment according to the invention at between 1300° C.≦T≦1315° C. results in a low dislocation density, produced by the stress relief annealing and the annihilation process, much less remaining eutectic of from 1 to 4% by volume and a much better homogenization. Due to the above, the same pinning effect of the grain boundaries of the recrystallization grains can be achieved by much less remaining eutectic, of 1 to 4% by volume, with a much better homogenization of the remaining body.

With a solution annealing process at above 1315° C., the entire γ' eutectic would be dissolved, followed by recrystallization of the components, without impeding the grain growth.

e) The monocrystalline blade is then quenched using a stream of argon.

Figure 4:
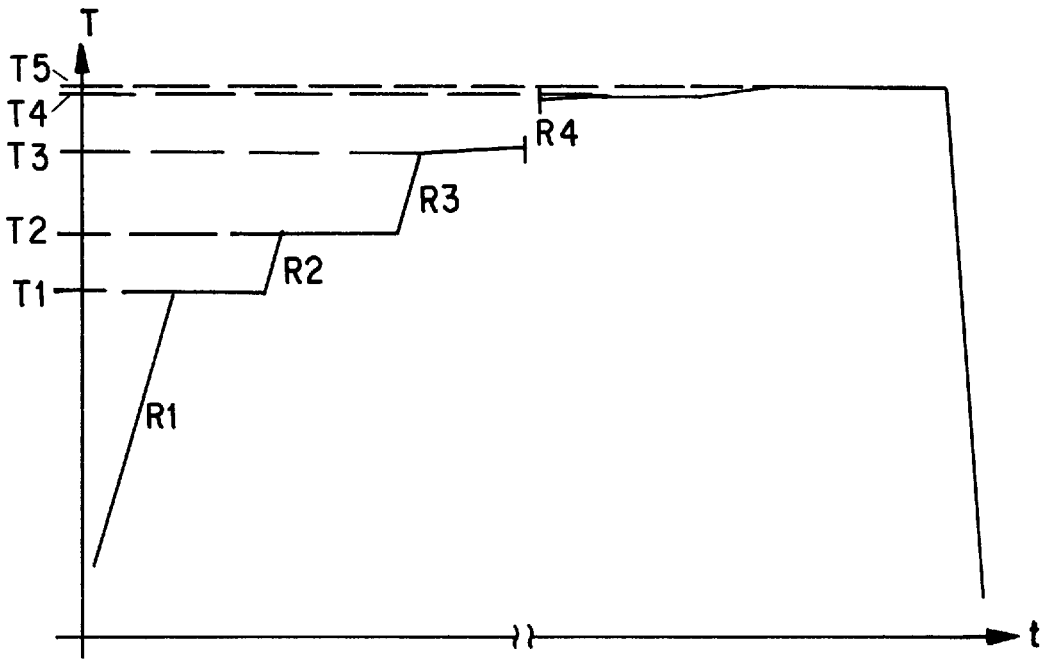
FIG. 4 shows a diagrammatic representation of a heat treatment process according to the invention for a monocrystalline blade.

A particularly advantageous embodiment of the heat treatment process according to the invention is illustrated diagrammatically in FIG. 4, which shows the time t plotted against the temperature T. The monocrystalline blade is heated up at a heat-up rate R1=10° C./min to a temperature T1=950° C. and is held at T1 for 1–4 hours. The monocrystalline blade is then heated up at a heat-up rate R2=10° C./min to a temperature T2=1050° C. and is held at T2 for 2–20 hours. The monocrystalline blade is then heated up at a heat-up rate R3=10° C./min to a temperature T3=1200° C. The monocrystalline blade is then heated up at a heat-up rate R4=0.5° C./min to a temperature T4=1300° C. and is held at T4 for 2 hours. The monocrystalline blade is then heated up to a temperature T5=1310° C. and is held at T5 for 6–12 hours and is then quenched with a stream of argon.

Naturally, the invention is not limited to the exemplary embodiment which has been shown and described. The above-describe heat treatment process may also be used for other nickel base superalloys having a similar solidus line, melting temperature and γ'-dissolution temperature.

TABLE 1

Recrystallization (Rx) of predeformed CMSX-4 specimens

| | Heat treatment | | | |
|---|---|---|---|---|
| Extension in % | Solution annealing at 1320 ± 4° C.; residual eutectic <0.5% | 2 h at 950° C. + 2 h at 1050° C. following a); solution annealing at 1320 ± 4° C. | Heating rate of 0.5° C. between 1200 and 1300° C. following c); solution annealing at 1320 ± 4° C. | In accordance with the invention, corresponding to FIG. 4 |
| 1.0 | No Rx | No Rx | No Rx | No Rx |
| 2.0 | No Rx | No Rx | No Rx | No Rx |
| 3.0 | Rx | No Rx | No Rx | No Rx |
| 3.5 | Rx | Rx | No Rx | No Rx |
| 4.0 | Rx | Rx | Rx | No Rx |
| 5.0 | Rx | Rx | Rx | Removable Rx grains |

TABLE 2

Properties of sand-blasted specimens after various solution treatments and aging at 1050° C.

| | Heat treatment of CMSX-4 specimens | |
|---|---|---|
| | According to U.S. Pat. No. 4,643,782 at T < 1300° C. | According to the invention at T > 1300° C. |
| Recrystallization | none | none |
| Brittle depositions after 1000 h at 1050° C. | needles (Re-Cr-rich) >3% by volume | none |
| Time until 1% creep at 1000° C./260 MPa in h | 34 | 51 |
| LCF test (fatigue at low number of cycles to failure): total strain amplitude in % at 1000° C., 6%/min, $Ni_{2\%}$ = 3000 cycles | $\Delta\epsilon_{tot}$ = 0.8 | $\Delta\epsilon_{tot}$ = 1.0 |

Obviously, numerous modifications and variations of the present invention are possible in light of the above teachings. It is therefore to be understood that within the scope of the appended claims, the invention may be practiced otherwise than as specifically described herein.

What is claimed is:

1. A heat treatment process for material bodies made of nickel base superalloys, wherein the heat treatment of the material body comprises the following sequential steps: annealing at 850° C. to 1100° C., heating to 1200° C., heating to a temperature of 1200° C.<T≦1300° C. at a heat-up rate of less than or equal to 1° C./min, and a multistage homogenization and dissolution process at a temperature of 1300° C.≦T≦1315° C. so as to achieve a residual eutectic of 1 to 4% by volume.

2. The heat treatment process of claim 1, wherein annealing is carried out at a temperature of 930° C.≦T≦970° C. for 1 to 4 hours and at a temperature of 1030° C.≦T≦1070° C. for 2 to 20 hours.

3. The heat treatment process or claim 1, wherein annealing is carried out at a temperature of about 950° C. for 1 to 4 hours and at a temperature of about 1050° C. for 2 to 20 hours.

4. The heat treatment process or claim 1, wherein the body is heated to a temperature of 1200° C.<T≦1300° C. at a heat-up rate of about 0.5° C./min.

5. The heat treatment process as claimed in claim 1, wherein the homogenization and dissolution process comprises: annealing at about 1300° C. for about 2 hours and then at about 1310° C. for 6 to 12 hours.

6. The heat treatment process of claim 1, wherein a material body is heat treated which is essentially composed of (in % by weight): 9.3–10.0 Co, 6.4–6.8 Cr, 0.5–0.7 Mo, 6.2–6.6 W, 6.3–6.7 Ta, 5.45–5.75 Al, 0.8–1.2 Ti, 0.07–0.12 Hf, 2.8–3.2 Re, remainder nickel.

7. The heat treatment process of claim 1, wherein a material body is heat treated which has an approximately identical solidus line, melting temperature and γ' dissolution temperature as a material body which is essentially composed of (in % by weight): 9.3–10 Co, 6.4–6.8 Cr, 0.5–0.7 Mo, 6.2–6.6 W, 6.3–6.7 Ta, 5.45–5.75 Al, 0.8–1.2 Ti, 0.07–0.12 Hf, 2.8–3.2 Re, remainder nickel.

8. The heat treatment process of claim 1, wherein the material body is a monocrystalline turbine blade.

9. The heat treatment process of claim 1, wherein the annealing at 850° C. to 1100° C. is effective to relieve stresses in the material body.

10. The heat treatment process of claim 1, wherein the annealing at 850° C. to 1100° C. is effective in closing dislocation sources.

11. The heat treatment process of claim 1, wherein the heating to 1200° C. is at a rate of 2 to 20° C./minute.

12. The heat treatment process of claim 1, wherein the heating to 1200° C.<T≦1300° C. is effective for dislocation network annihilation in the material body.

13. The heat treatment process of claim 1, wherein the multistage homogenization and dissolution process is followed by quenching the material body.

14. The heat treatment process of claim 1, wherein the multistage homogenization and dissolution process is followed by quenching the material body in a stream of argon.

15. The heat treatment process of claim 1, wherein the residual eutectic is effective to pin grain boundaries of recrystallization grains formed during the multistage homogenization and dissolution process.

* * * * *